US005577441A

United States Patent [19]

Grabscheid

[11] Patent Number: 5,577,441

[45] Date of Patent: Nov. 26, 1996

[54] PRESSING DEVICE FOR EXTRACTING LIQUID FROM A PULP WEB

[75] Inventor: Joachim Grabscheid, Heuchlingen, Germany

[73] Assignee: Voith Sulzer Paperiermaschinen Gesellschaft mbH, Heidenheim, Germany

[21] Appl. No.: 423,888

[22] Filed: Apr. 18, 1995

[30] Foreign Application Priority Data

Apr. 19, 1994 [DE] Germany ..... 44 13 544.0

[51] Int. Cl.[6] ..... B30B 3/04

[52] U.S. Cl. ..... 100/168; 162/358.3

[58] Field of Search ..... 100/118, 153, 100/158 R, 168; 162/358.3

[56] References Cited

U.S. PATENT DOCUMENTS

| | | | |
|---|---|---|---|
| 811,527 | 1/1906 | Aldrich | 100/168 |
| 3,055,242 | 9/1962 | Wilson | 100/168 |
| 3,856,461 | 12/1974 | Jordan | 100/168 |
| 5,291,826 | 3/1994 | Schiel | 100/168 |
| 5,338,279 | 8/1994 | Schiel | 492/7 |
| 5,395,172 | 3/1995 | Grabscheid | 384/557 |
| 5,413,036 | 5/1995 | Schiel | 100/168 |

FOREIGN PATENT DOCUMENTS

| | | |
|---|---|---|
| 9203395.4 | 6/1992 | Germany . |
| 4210685 | 4/1993 | Germany . |
| 92/17641 | 10/1992 | WIPO . |

*Primary Examiner*—Stephen F. Gerrity
*Attorney, Agent, or Firm*—Pretty, Schroeder, Brueggeman & Clark

[57] ABSTRACT

A pressing device for extracting water from a pulp web comprises two press rolls that form between them a nip and that are arranged to extend substantially in parallel one to the other in the unloaded condition. The first press roll has its two ends supported in first bearing blocks and is stationarily fixed in the axial direction at least on one end. The second press roll is supported by its two ends in two bearing blocks. The first bearing blocks and the second bearing blocks can be braced one to the other by tension members which allow the press rolls to perform a relative movement in the axial direction under load. One of the second bearing blocks is secured against displacement in the axial direction on the lower first bearing block, by an articulated joint acting preferably on the middle of the longitudinal extension of the tension element. This minimizes the bending stress exerted on the tension elements and distributes it uniformly over the two ends of the tension elements, provided a central point of attack is selected for the articulated joint.

8 Claims, 2 Drawing Sheets

PRESSING DEVICE FOR EXTRACTING LIQUID FROM A PULP WEB

BACKGROUND OF THE INVENTION

The present invention relates to a pressing device for extracting liquid from an aqueous pulp web, said pressing device having two press rolls that form between them a nip, a first press roll having its two ends supported in first bearing blocks and being stationarily fixed at least on one end, and the second press roll being supported by its two ends in second bearing blocks that can be braced against the first bearing blocks by means of tension members, which tension members allow the press rolls to perform a relative movement in the axial direction under load.

A pressing device of this kind is known from U.S. Pat. No. 5,291,826.

In the case of the known pressing device, two press rolls are arranged in parallel one to the other, forming between them a press nip. Given the fact that the first bearing blocks and the second bearing blocks are braced by means of tension elements, a short flux of force is obtained for the transmission of the pressing force in the press nip, which avoids stresses on the elements of the supporting structure. Thus, the supporting structure only has to transmit the weight of the press proper, not the high pressing forces. This results in a simpler, less heavy and space-saving structure. In the known pressing device, the tension elements consist of a central portion resembling a leaf spring, and hammer hands on their ends that are held in grooves provided in the bearing blocks. Thus, the bearing blocks are rigidly connected with the hammer heads of the tension elements. At the same time, the tension elements, being flexible in the axial direction of the press rolls, allow the press rolls to bend relative one to the other, and to be axially displaced a certain amount relative one to the other during operation, as a consequence of high pressing forces or due to variations in length that may be caused, for example, by thermal conditions. In the unloaded condition of the pressing device, the tension elements are biased either not at all, or only very slightly.

Further, both press rolls have one of their ends fixed stationarily on the frame, via their bearing blocks. While this is achieved for the first roll by rigidly connecting a bearing block with the frame, the second press roll is provided for this purpose, on its opposite end, with a sliding guide by means of which the bearing block of the second press roll is fixed on the machine frame in the axial direction, but is capable of being displaced in the vertical direction.

It has been found in the case of the known pressing device that the tension elements, by means of which the pressing forces are transmitted during operation between the two press rolls, may be subjected to considerable bending stresses, which has a detrimental effect on the load capacity of the tension elements.

SUMMARY OF THE INVENTION

Now, it is the object of the present invention to improve a pressing device of the afore-mentioned kind in such a way as to reduce the maximum bending stress to which the tension elements may be subjected during operation.

This object is achieved by the invention due to the fact that one of the second bearing blocks of a pressing device of the before-mentioned kind is secured against axial displacement on one of the first bearing blocks.

The object of the invention is thus fully achieved, the bending stresses acting on the tension elements being considerably reduced as compared with conventional arrangements.

This is substantially achieved by the fact that instead of fixing the second press roll directly on the machine frame against axial movement, it is now guided in the axial direction on the bearing block of the first press roll.

This considerably reduces the bending stresses acting on the tension elements, that may occur as a result of axial forces acting on the press roll, which latter is fixed in position via the tension elements, because the bending stresses can no longer occur on one side only, but will instead be distributed over the length of the tension elements.

Generally it is possible to connect the ends of the tension elements via articulations with the first or second bearing blocks, respectively, whereby a four-bar linkage is created.

According to a preferred further development of the invention, the tension elements are, however, flexibly deformable in the axial direction of the press rolls and rigidly clamped at their ends on the first or second bearing blocks, respectively.

This results in a particularly simple and space-saving structure, there being no need for additional articulated joints.

According to a preferred further improvement of the invention, one of the second bearing blocks is coupled with the first bearing block via an articulated joint that is fixed in the axial direction of the press rolls, but movable in the longitudinal direction of the tension elements.

This arrangement provides a particularly simple way of axially fixing the second bearing block on the first bearing block.

According to a preferred further development of the invention, the articulated joint acts on the tension element in the middle of its longitudinal extension.

This feature provides the advantage that the maximum bending stress acting on the tension elements is further reduced due to the fact that only half the bending stress can appear on each firmly clamped end of a tension element. Thus, even greater flexion of the press rolls under the load in the press nip can be tolerated for a given size of tension elements, since the bending stresses resulting therefrom are uniformly distributed over the two ends of the tension elements.

A particularly simple design is obtained for the articulated joint when the latter comprises a stud that is held in a guide for being displaced in vertical direction.

According to another embodiment of the invention, it is proposed to fix the bearing blocks one to the other on the drive end.

This feature provides the advantage that the articulated joint does not present an obstruction when a press blanket guided on one of the two press rolls or an endless felt guided through the press nip has to be exchanged.

According to another advantageous embodiment of the invention the tension elements are designed as tension members in the form of leaf springs, exhibiting a substantially I-shaped cross-section and hammer heads on their ends, with relief grooves being provided in the lateral faces of the hammer heads, transversely to the axial direction.

Although is has been generally known from U.S. Pat. No. 5,291,826 to provide tension members in the form of leaf springs, that exhibit a substantially I-shaped cross-section and hammer heads on their ends, a particularly gentle rise of the surface pressure on the hammer heads, from the outside to the inside, can be achieved by the additional arrangement of relief grooves extending in the lateral faces of the hammer heads transversely to the exial direction, so that the notch effect at the hammer heads can be reduced to a minimum and, accordingly, the strength of the tension elements can be further increased also under continuous operation conditions.

It is understood that the features mentioned above and those yet to be explained below can be used not only in the respective combinations indicated, but also in other combinations or in isolation, without leaving the scope of the present invention.

SHORT DESCRIPTION OF THE DRAWINGS

A particularly preferred embodiment of the invention will be described hereafter in more detail with reference to the drawing in which:

FIG. 1 shows an elevation of a pressing device according to the invention, in a very simplified, diagrammatic representation; and FIG. 2 shows an enlarged cross-section through part of a tension element according to the invention, in the area of its hammer head which latter engages a T-shaped groove in the bearing housing.

DETAILED DESCRIPTION OF THE PREFERRED EMBODIMENT

Figure 1:
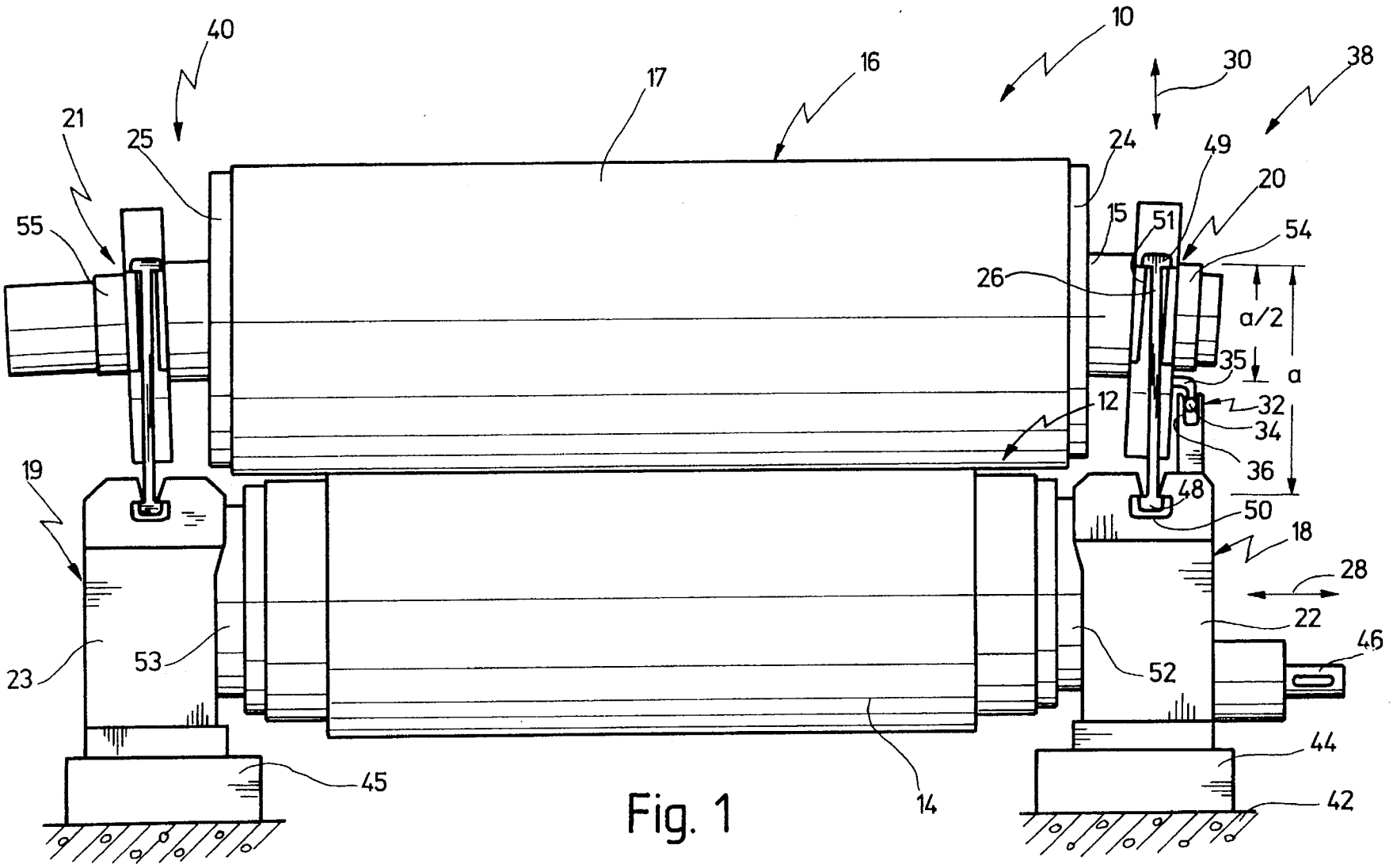
Figure 2:
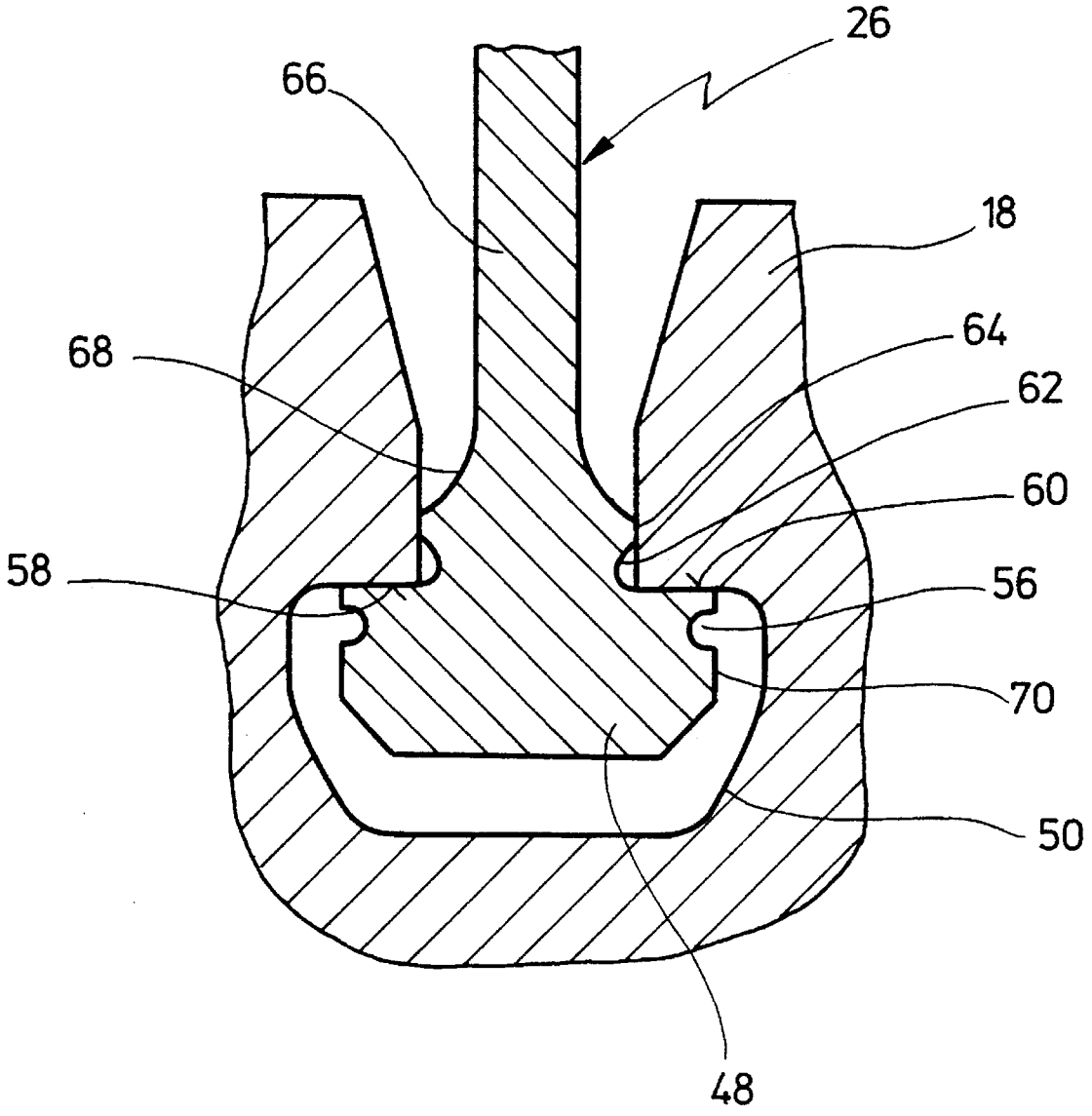

In FIG. 1, a pressing device according to the invention is indicated generally be reference numeral 10.

The pressing device 10 comprises a first press roll 14, configured as so-called deflection adjusting roll, and a second press roll 16 arranged in parallel to the first press roll 14 and above the latter and configured as a shoe press roll with a hydraulically operated press shoe. The structure of a deflection adjusting roll and a shoe press roll is generally known; reference is made in this connection to U.S. Pat. No. 5,338,279 and DE 92 03 395 U1 which are both incorporated by reference.

The first press roll 14 and the second press roll 16, on which a press blanket 17 is carried in the known way, form between them a press nip 12 through which a pulp web, from which water is to be extracted, is guided usually together with at least one felt (not shown).

In the illustrated case, the first press roll 14 has its two ends supported in first bearings 22, 23 whose bearing housings are designed as bearing blocks 18, 19, each mounted on a frame 44, 45, the latter being fixed in position on a base 42.

The first press roll 14 is driven, on the drive side 38, via a drive bushing 46 and an intermediate gear.

While the first drive-end bearing 22 of the first press roll 14 is configured as a locating bearing, that does not allow any displacement of the journal 52 of the first press roll 14 in the axial direction 28, the second bearing 23 of the first press roll 14 on the guiding end 40 is configured as a floating bearing enabling the journal 53 to be displaced in the bearing 23 in order to compensate for variations in length, and the like. More specifically, the second bearing 23 is connected with the frame 44 via a support, according to DE 42 10 685 C1, while the possibility to perform an axial displacement is created between the bearing 23 and the frame (not shown).

The second press roll 16 is provided on its two ends with stationary journals 54, 55 that are rigidly connected with second bearing blocks 20 and 21, respectively, on the drive end 38 and on the guiding end 40, respectively. The press blanket 17 of the second press roll 16 is supported in the conventional way via second bearings 24, 25 on a stationary yoke 15, whose two ends constitute the second journals 54, 55 that are connected in fixed relationship with the second bearing blocks 20, 21.

The second bearing blocks 20, 21 are fixed on each end of the second press roll 16 in pairs, via tension elements 26, on the first bearing blocks 18, 19 located below them.

Normally, the tension elements 26 are not pre-stressed at all, or only very slightly; under load conditions, however, when the press shoe of the second press roll 16 is urged against the first press roll 14, they take up the load and transmit it directly to the first bearing blocks 18, 19. This guarantees a direct flux of force from the second bearing blocks 20, 21 via the tension elements 26 to the first bearing blocks 18, 19 under load conditions.

Further, under load conditions an axial displacement between the first press roll 14 and the second press roll 16 is in principle possible.

According to the invention, the second drive-end bearing block 20 is now connected with the first drive-end bearing block 18 via an articulated joint 32. In the simplest of all cases, this articulated joint 32 consists of an arm 35 that acts on the tension element 26 at the middle a/2 of its longitudinal extension and that carries on its end a stud 34 which is rotatably held in a guide extending in the vertical direction 30, for being displaced in the vertical direction 30. The guide 36 is rigidly connected with the first drive-end bearing block 18. Thus, the second drive-end bearing block 20 is fixed on the lower first bearing block 18 in the axial direction 28, whereas it is permitted to move in the vertical direction 30 if, for example, the tension elements 26 should expand under load.

Due to the fact that the second press roll 16 is fixed in position on the first bearing block 18 on the drive end 38, via the articulated joint 32, the bending stress exerted on the tension elements 26 is minimized and, if the articulated joint 32 is arranged in the middle of the longitudinal extension of the tension elements 26, uniformly distributed over the ends of the tension elements 26.

Such axial forces may be due, for example, to hose connections or to irregularities in the press blanket of the second press roll 16.

The bending stress of the tension elements 26 is minimized by the described articulated joint 32 so that greater deflections of the tension elements under load are permissible for identically sized tension elements 26, without the risk of the tension elements 26 being subjected to excessive bending stresses.

The tension elements 26 are provided on both ends with hammer heads 48, 49 and are held by their lower hammer heads in T-shaped grooves 50 in the first bearing blocks 18, 19, while their upper hammer heads 49 engage simple grooves 51 in the second bearing blocks 20, 21.

In order to ensure that the bending stresses will be introduced into the ends of the tension elements 26 as gently as possible, and to exclude the creation of notch stresses, the lateral faces 70 of the hammer heads 48 and 49 are provided with relief grooves 56 of semi-circular cross-section that extend along the lateral faces 70 transversely to the axial direction 28. These relief grooves 56 enable the forces to be introduced particularly gently via the end faces 58 of the hammer heads 48 and 49 that rest against the mating end faces 60 of the bearing blocks 18 and 20, respectively.

In order to secure the tension elements 26 against displacements in the grooves 50 and 51 in the axial direction 28, the tension elements 26 are provided, in the direct vicinity of the hammer heads 48 and 49, with reinforcing beads 64 which have their lateral faces in contact with the lateral flanks of the grooves 50 and 51, respectively. Between the reinforcing beads 64 and the beginning of the hammer heads 48 and 49, respectively, there are provided undercuts 62 of semi-circular cross-section. On the side opposite the hammer heads 48 and 49, respectively, the reinforcing beads 64 terminate by curved sections 68 that form the transition to the central portion 66 of the tension elements 26.

This structure and mounting arrangement altogether enables bending stresses to be introduced gently, via the hammer heads 48 and 49, respectively, into the narrower central portion 66 of the tension elements 26.

It is understood that in addition to the configuration of the pressing device 10 with "floating" shoe press roll arranged above the other press roll, as illustrated in FIG. 1, numerous other configurations are possible without leaving the scope of the invention.

For example, the first press roll 14 may, instead of being designed as a deflection adjusting roll, also take the form of a solid roll. Because of the lower deflection of the two press rolls 14, 16, due to the lower pressing forces, the articulated joints 32 between the two bearing blocks 18, 20 may in this case also act on a different point of the bearing blocks, i.e. on an off-center point of the tension elements 26, which would allow a simpler structure as the bending stresses are anyway lower in this case, due to the smaller deflection.

In addition, it is of course also imaginable to arrange the shoe press roll at the bottom, and the other press roll as upper "floating" back-up roll. It would be recommendable in this case, too, to arrange the articulated joint 32 at the middle of the longitudinal extension of the tension elements 26.

Preferably, a similar arrangement will be selected also in case the back-up roll is configured as a solid roll, instead of being designed as a deflection adjusting roll.

I claim:

1. Pressing device for extracting liquid from a pulp web passing through a press nip, said device comprising:

first and second press rolls each having a roll axis and arranged in parallel to one another and forming said nip;

a support;

first bearing blocks for supporting two ends of said first press roll, both of said first bearing blocks being supported by said support and at least one of said first bearing blocks being stationarily fixed relative to said support, while a second one of said first bearing blocks allows axial movement of one of said two ends of said first press roll relative to said support;

second bearing blocks for supporting two ends of said second press roll;

longitudinally extending tension elements for supporting said second bearing blocks on said first bearing blocks and adapted for bracing said second bearing blocks against said first bearing blocks, said tension elements allowing axial movement of said press rolls relative to one another under load; and means for securing one of said second bearing blocks on one of said first bearing blocks against axial movement relative to said one of said first bearing blocks.

2. Pressing device according to claim 1, wherein said tension elements are flexibly deformable in the axial direction of the press rolls and rigidly clamped at their ends on the first and second bearing blocks, respectively.

3. Pressing device according to claim 1, wherein said means for securing said one of the second bearing blocks on said one of said first bearing blocks comprises an articulated joint that is fixed in the axial direction of the press rolls, but movable in a longitudinal direction of said tension elements.

4. Pressing device according to claim 3, wherein said articulated joint is fixed to said one of said second bearing blocks substantially at the middle of the longitudinal extension of one of said tension elements.

5. Pressing device according to claim 4, wherein said articulated joint comprises a stud that is held in a guide, said guide allowing displacement of the stud in a direction of a plane passing through the nip and the roll axes.

6. Pressing device according to claim 1, wherein said means for securing is fixed to said one of said second bearing blocks substantially at the middle of the longitudinal extension of one of said tension elements.

7. Pressing device according to claim 1, wherein said means for securing is arranged on a driven end of said pressing device.

8. Pressing device according to claim 1, wherein said tension elements are configured as tension bars in the form of leaf springs, exhibiting a substantially I-shaped cross-section and hammer heads on their ends, with relief grooves being provided in lateral faces of said hammer heads, transversely to the axial direction.

* * * * *